US010395603B2

(12) United States Patent
Kang et al.

(10) Patent No.: US 10,395,603 B2
(45) Date of Patent: Aug. 27, 2019

(54) DISPLAY DEVICE AND ELECTRONIC DEVICE HAVING THE SAME

(71) Applicant: Samsung Display Co., Ltd, Yongin-si, Gyeonggi-do (KR)

(72) Inventors: Ji-Na Kang, Hwaseong-si (KR); Chun-Seok Ko, Hwaseong-si (KR); Se-Ho Kim, Seoul (KR)

(73) Assignee: Samsung Display Co., Ltd. (KR)

( * ) Notice: Subject to any disclaimer, the term of this patent is extended or adjusted under 35 U.S.C. 154(b) by 12 days.

(21) Appl. No.: 15/436,106

(22) Filed: Feb. 17, 2017

(65) Prior Publication Data

US 2017/0243545 A1 Aug. 24, 2017

(30) Foreign Application Priority Data

Feb. 23, 2016 (KR) ..... 10-2016-0021097

(51) Int. Cl.
*G09G 3/3233* (2016.01)
*G09G 3/3258* (2016.01)
*G09G 3/3291* (2016.01)

(52) U.S. Cl.
CPC ..... *G09G 3/3291* (2013.01); *G09G 3/3233* (2013.01); *G09G 3/3258* (2013.01); *G09G 2300/08* (2013.01); *G09G 2300/0819* (2013.01); *G09G 2300/0852* (2013.01); *G09G 2300/0866* (2013.01); *G09G 2310/0289* (2013.01); *G09G 2310/08* (2013.01); *G09G 2320/0223* (2013.01); *G09G 2320/0233* (2013.01)

(58) Field of Classification Search
None
See application file for complete search history.

(56) References Cited

U.S. PATENT DOCUMENTS

2012/0069059 A1* 3/2012 Lee ..... G09G 3/3225 345/690

FOREIGN PATENT DOCUMENTS

KR 10-2009-0072393 A 7/2009
KR 10-2011-0067450 A 6/2011

* cited by examiner

*Primary Examiner* — Gustavo Polo
(74) *Attorney, Agent, or Firm* — Innovation Counsel LLP

(57) ABSTRACT

A display device includes a display panel including pixels, a data driver configured to provide a data signal and an emission voltage to the pixels through the data lines, a scan driver configured to provide a scan signal to the pixels through the scan lines, a power voltage provider configured to provide a high power voltage to the pixels through a high power voltage line and to provide a low power voltage to the pixels through a low power voltage line, and a timing controller configured to generate control signals that control the data driver and the scan driver. The display panel includes a power controller that determines whether the data line is coupled to the high power voltage line or to the low power voltage line.

20 Claims, 8 Drawing Sheets

DISPLAY DEVICE AND ELECTRONIC DEVICE HAVING THE SAME

CROSS-REFERENCE TO RELATED APPLICATION(S)

This application claims priority under 35 USC § 119 to Korean Patent Application No. 10-2016-0021097, filed on Feb. 23, 2016 in the Korean Intellectual Property Office (KIPO), the contents of which are incorporated herein in its entirety by reference.

BACKGROUND

1. Technical Field

Example embodiments relate generally to a display device and an electronic device having the same. More particularly, embodiments of the present inventive concept relate to a pixel and a display device having the same.

2. Description of the Related Art

Flat panel display (FPD) devices are widely used as a display device of electronic devices because FPD devices are relatively lightweight and thin compared to cathode-ray tube (CRT) display device. Examples of FPD devices include liquid crystal display (LCD) devices, field emission display (FED) devices, plasma display panel (PDP) devices, and organic light emitting display (OLED) devices. The OLED devices have been spotlighted as next-generation display devices because they have various advantages, such as a wide viewing angle, rapid response speed, thin thickness, low power consumption, among other benefits.

A resolution or a size of a power voltage and a current provided to a pixel may be decreased by a voltage drop in an emission period. In this case, a brightness of the pixel may be decreased.

SUMMARY

Some example embodiments provide a display device capable of compensating a voltage drop of a power voltage provided to a pixel.

Some example embodiments provide an electronic device capable of compensating a voltage drop of a power voltage provided to a pixel.

According to an aspect of example embodiments, a display device may include a display panel including a plurality of pixels, a data driver configured to provide a data signal and an emission voltage to the plurality of pixels through a plurality of data lines, a scan driver configured to provide a scan signal to the plurality of pixels through the scan lines, a power voltage provider configured to provide a high power voltage to the plurality of pixels through a high power voltage line and to provide a low power voltage to the plurality of pixels through a low power voltage line, and a timing controller configured to generate control signals that control the data driver and the scan driver. The display panel may include a power controller which determines whether the data line is coupled to the high power voltage line or to the low power voltage line.

In example embodiments, the power controller may include a plurality of power switches that turn on or turn off in response to a switching signal.

In example embodiments, wherein at least one power switch a plurality of may be formed between the high power voltage line and the data line.

In example embodiments, the at least one power switch may turn on during an emission period of a pixel of the plurality of pixels.

In example embodiments, the data driver may provide the emission voltage to the pixel through the data line during an emission period of the pixel.

In example embodiments, the at least one power switch may be formed between the low power voltage line and the data line.

In example embodiments, wherein the at least one power switch may turn on during an emission period of a pixel of the plurality of pixels.

In example embodiments, the data driver may provide the emission voltage to the pixels through the data line during an emission period of the pixel.

In example embodiments, the at least one power switch may be implemented as a p-channel metal oxide semiconductor (PMOS) transistor.

In example embodiments, the at least one power switch may be implemented as an n-channel metal oxide semiconductor (NMOS) transistor.

In example embodiments, the power controller may be formed in a non-display area of the display panel.

According to an aspect of example embodiments, an electronic device may include a display device and a processor that controls the display device. The display device may include a display panel including a plurality of pixels, a data driver configured to provide a data signal and an emission voltage to the pixels through a plurality of data lines, a scan driver configured to provide a scan signal to the plurality of pixels through the scan lines, a power voltage provider configured to provide a high power voltage to the plurality of pixels through a high power voltage line and to provide a low power voltage to the plurality of pixels through a low power voltage line, and a timing controller configured to generate control signals that control the data driver and the scan driver. The display panel may include a power controller that determines whether the data line is coupled to the high power voltage line or to the low power voltage line.

In example embodiments, the power controller may include a plurality of power switches that turn on or turn off in response to a switching signal.

In example embodiments, wherein the power switch may be formed between the high power voltage line and the data line.

In example embodiments, the at least one power switch of the plurality of power switches may turn on during an emission period of the pixel.

In example embodiments, the data driver may provide the emission voltage to a pixel of the plurality of pixels through the data line during an emission period of the pixel.

In example embodiments, the at least one power switch of the plurality of power switches may be formed between the low power voltage line and the data line.

In example embodiments, the at least one power switch may turn on during an emission period of a pixel of the plurality of pixels.

In example embodiments, the data driver may provide the emission voltage to the pixels through the data line during an emission period of the pixel.

In example embodiments, the power controller may be formed in a non-display area of the display panel.

Therefore, a display device and an electronic device may compensate a brightness of a pixel occurs by a voltage drop of a power voltage provided the pixel by providing an emission voltage to the pixel through a data line during an emission period. Thus, a display quality of the display device may improve.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Hereinafter, the present inventive concept will be explained in detail with reference to the accompanying drawings.

Figure 1:
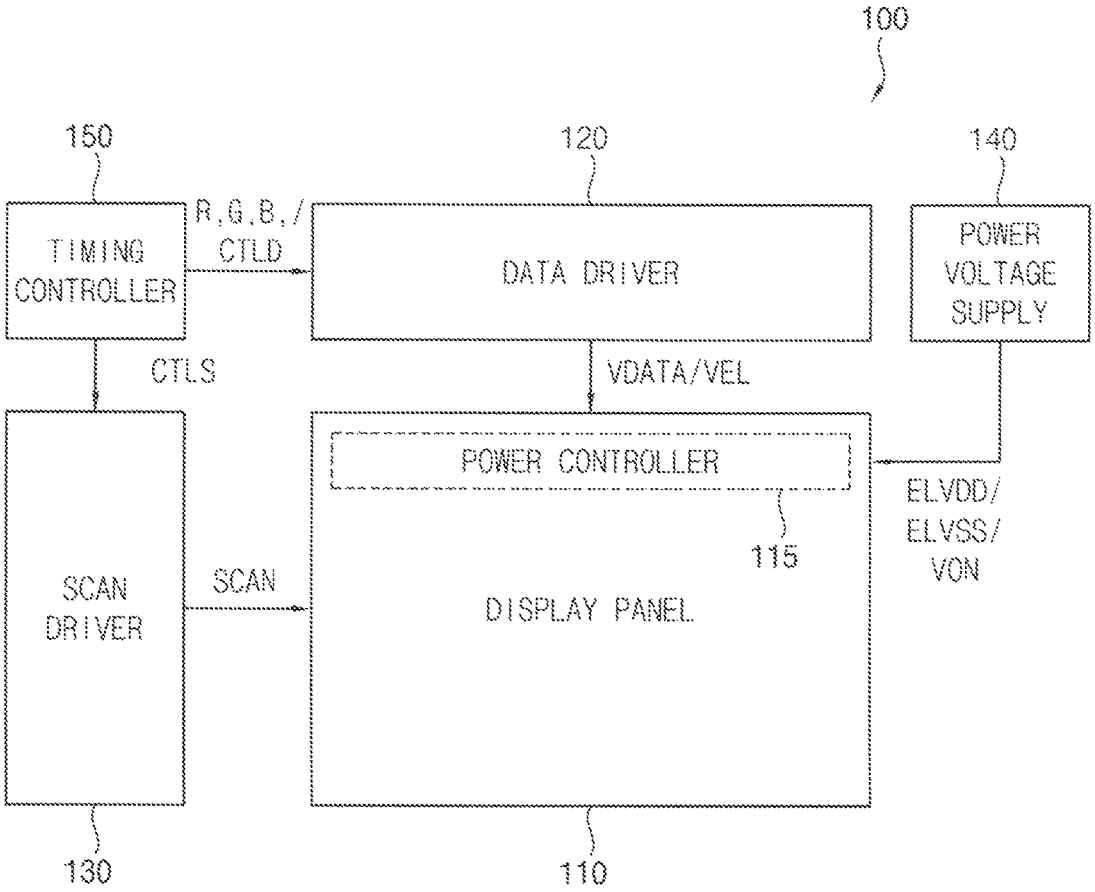
FIG. 1 is a block diagram illustrating a display device according to example embodiments.

FIG. 1 is a block diagram illustrating a display device according to example embodiments.

Referring to FIG. 1, a display device 100 may include a display panel 110, a data driver 120, a scan driver 130, a power voltage provider 140, and a timing controller 150.

When the display device 100 is driven in a simultaneous emission with active voltage (SEAV) method, the pixel may be operated such that in a first period an organic light emitting diode is initiated, in a second period a threshold voltage of a driving transistor is compensated, in a third period the data signal is input to a capacitor, and in a fourth period the organic light emitting diode emits. An on-bias voltage VON may be provided to the pixel through a data line during the first period. A data signal VDATA may be provided to the pixel through the data line during the third period. No signals may be provided to the pixel through the data line during the second period and the fourth period. In the case where a high power voltage and a low power voltage are insufficiently provided to the pixels during the fourth, brightness of the pixel may reduced. To overcome these problems, the display device 100 of FIG. 1 may couple the data line to the high power voltage line or couple the data line to the low power voltage line, and provide the emission voltage VEL to the pixel through the data line during the fourth period. Hereinafter, the display device 100 of FIG. 1 will be described in detail.

A plurality of data lines and a plurality of scan lines may be formed on the display panel 110. The plurality of pixels may be formed in intersection regions of the data lines and the scan lines. Each of the pixels may include switching transistors, a driving transistor, an organic light emitting diode, and capacitors. Here, the data line may be coupled to the pixel by a scan switching transistor included in the pixel. The pixel will be described in detail referring to FIGS. 3 and 5.

The display panel 110 may include a power controller 115. The power controller 115 may determine whether the data line is coupled to the high power voltage line or the low power voltage line. The power controller 115 may not couple the data line and high power voltage line or low power voltage line during the first period in which the organic emitting diode is initiated, nor during the second period in which the threshold voltage of the driving transistor is compensated. The power controller 115 may couple the data line and high power voltage line or low power voltage line during the fourth period in which the organic light emitting diode emits. The power controller 115 may include power switches that turn on or turn off in response to a switching signal. In some example embodiments, the power switch may be formed between the high power voltage line and the data line. The power switch may turn on during the fourth period in which the organic light emitting diode emits light. Here, the scan switching transistor included in the pixel may turn off and the data line may not be coupled to the pixel during the fourth period. An emission voltage VEL provided from the data driver 120 may be provided to the high power voltage line through the data line. Thus, the emission voltage provided from the data driver 120 and the high power voltage ELVDD provided from the power voltage generator may be provided to the pixel through the high power voltage line. Here, the emission voltage may be greater than 0 V. For example, the emission voltage VEL may have a voltage level that compensates for a voltage drop of the high power voltage ELVDD. Alternatively, the emission voltage VEL may have a voltage level that compensates for a brightness reduction resulting from a degradation of the pixel. In other example embodiments, the power switch may be formed between the data line and the low power voltage line. The power switch may turn on during the fourth period in which the organic light emitting diode emits light. Here, the scan switching transistor included in the pixel may turn off and the data line may not be coupled to the pixel during the fourth period. The emission voltage VEL provided from the data driver may be provided to the low power voltage line through the data line during the fourth period. Thus, the emission voltage VEL provided from the data driver 120 and the low power voltage ELVSS provided from the power voltage provider may be provided to the pixel through the low power voltage line. Here, the emission voltage VEL may be less than 0 V. For example, the emission voltage VEL may have a voltage level that compensates for a voltage drop of the low power voltage ELVSS. Alternatively, the emission voltage VEL may have a voltage level that compensates for a brightness reduction of the pixel resulting from a degradation of the pixel. In some example embodiments, the power switch may be implemented as a p-channel metal oxide semiconductor (PMOS) transistor. In this case, the power switch may turn on in response to the switch signal having a low level (e.g., low gate voltage (VGL)). In other example embodiments, the power switch may be implemented as an n-channel metal oxide semiconductor (NMOS) transistor. In this case, the power switch may turn on in response to the switch signal having a high level (e.g., high gate voltage (VGH)).

The data driver 120 may provide the data signal VDATA and the emission voltage VEL to the pixels through the data lines. The data driver 120 may generate data signal VDATA based on an image data R, G, B and a data control signal CTLD provided from the timing controller 150. The data driver 120 may provide the data signal to the pixel through the data line during the third period. Here, the power switch may turn off during the third period. Thus, the data line may be decoupled from the high power voltage line or low power voltage line during the third period. The scan switching transistor included in the pixel may turn on during the third period. Thus, the data line may be coupled to the pixel. Then the scan switching transistor turns on, and the data signal VDATA generated in the data driver 120 may be provided to the pixel through the data line. The data driver may generate the emission voltage VEL based on the data control signal CTLD provided from the timing controller 150. Alternatively, the data driver 120 may receive the emission voltage VEL from the power voltage provider 140. The data driver 120 may provide the emission voltage VEL through the data line during the fourth period. The power switch in the power controller 115 may turn on and the data line may be coupled to the high power voltage line or the low power voltage line during the fourth period. Here, the scan switching transistor included in the pixel may turn off and the data line may be decoupled from the pixel. The emission voltage VEL generated in the data driver 120 may be provided to the high power voltage line or the low power voltage coupled to the data line.

The scan driver 130 may provide a scan signal SCAN to the pixels through the scan lines. The scan driver may generate scan signal SCAN based on a scan control signal CTLS provided from the timing controller 150. The scan driver 130 may provide the scan signal SCAN which turns on the scan switching transistor of the pixel during the first through third periods. The scan driver 130 may provide the scan signal SCAN that turns off the scan switching transistor of the pixel during the fourth period.

The power voltage provider 140 may provide the high power voltage ELVDD to the pixel through the high power voltage line and provide the low power voltage ELVSS to the pixel through the low power voltage line. The power voltage provider 140 may provide the high power voltage ELVDD and the low power voltage ELVSS during the fourth period. Further, the power voltage provider 140 may provide an on-bias voltage VON to the pixel during the first period. Here, the on-bias voltage VON may have a voltage level that turns on the driving transistor included in the pixel.

The timing controller 150 may generate the data control signal CTLD that controls the data driver 120 and the scan control signal CTLS that controls the scan driver 130. The timing controller 150 may generate the scan control signal CTLS and may provide the scan control signal CTLS to the scan driver 130. Further, the timing controller 150 may generate the data control signal CTLD and may provide the image data R, G, B and the data control signal CTLD to the data driver 120.

As described above, the display device 100 of FIG. 1 may form the power controller 115 in the display panel 110 and may couple the data line with the high power voltage line or the low power voltage line by turning on the power switches. Here, the data driver 120 may provide the emission voltage VEL through the data line. Thus, the voltage having a greater level than the high power voltage ELVDD may be provided to the pixels through the high power voltage line. Alternatively, the voltage having a lower level than the low power voltage ELVSS may be provided to the pixels through the low power voltage line. Therefore, the brightness of the pixel may increase as an amount of current provided to the organic light emitting diode included in the pixel increases.

Figure 2:
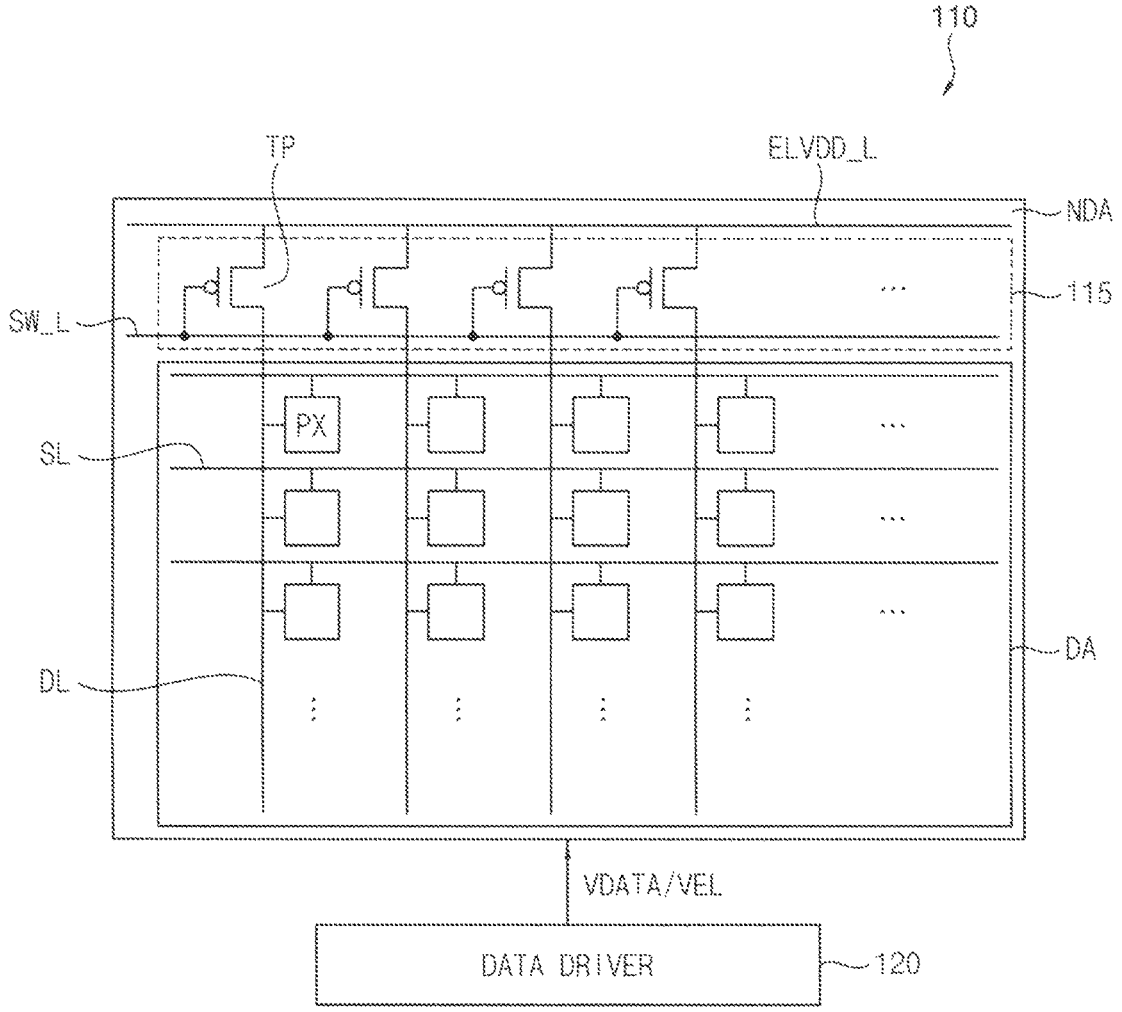
FIG. 2 is a diagram illustrating a display panel included in the display device of FIG. 1.

FIG. 2 is a diagram illustrating a display panel included in the display device of FIG. 1.

Referring to FIG. 2, the high power voltage line ELVDD_L may be formed in the display panel 110. Although the high power voltage line ELVDD_L is depicted as a line, the high power voltage line ELVDD_L is not limited thereto. For example, the high power voltage line ELVDD_L may be formed in a mesh structure. The high power voltage line ELVDD_L may be coupled to the power voltage provider. The power voltage provider may provide the high power voltage to the pixels PX through the high power voltage line ELVDD_L.

The plurality of data lines DL and the plurality of scan lines SL may be formed in a display area DA of the display panel 110. The pixels may be formed in the intersection regions of the data lines DL and the scan lines SL. The power controller 115 may be formed in the non-display area NDA of the display panel 110. The power controller 115 may include a plurality of power switches TP. The power switches TP may be formed between the high power voltage line ELVDD_L and the data line DL and may determine whether the data line DL is coupled to the high power voltage line ELVDD_L. A gate electrode of the power switch TP may be coupled to a switching line SW_L that provides the switching signal. The power switch TP may turn on or turn off in response to the switching signal. In some example embodiments, the power switch TP may be implemented as the PMOS transistor. In this case, the power switch TP may turn on in response to the switch signal having low level (e.g., low gate voltage (VGL)). In other example embodiments, the power switch TP may be implemented as the NMOS transistor. In this case, the power switch TP may turn on in response to the switch signal having a high level (e.g., high gate voltage (VGH)).

The power switch TP of the power controller 115 may turn on and the data line DL and the high power voltage line ELVDD_L may be coupled during the fourth period in which the pixel PX emits light. Here, the pixel PX is decoupled from the data line DL by turning off the scan switching transistor of the pixel PX. The data driver 120 may generate the emission voltage VEL during the fourth period. The emission voltage VEL generated in the data driver 120 may be provided to the high power voltage line ELVDD_L through the data line DL. Thus, the emission voltage VEL provided from the data driver 120 and the high power voltage provided from the power voltage provider may be provided to the pixel PX through the high power voltage line ELVDD_L during the fourth period. That is, the voltage having a greater level than the high power voltage may be provided to the pixel PX through the high power voltage line ELVDD_L during the fourth period. The power switch TP of the power controller 115 may turn off and the data line DL may be decoupled from the high power voltage line ELVDD_L during the first through third periods. Here, the scan switching transistor may turn on and the data line DL may be coupled to the pixel PX. The scan switching transistor may turn on and the on-bias voltage may be provided to the pixel PX through the data line DL during the first period. The scan switching transistor may turn on and the data signal VDATA may be provided to the pixel PX through the data line during the third period.

As described above, the power controller 115 may be formed in the non-display area of the display panel 110 and the may determine whether the data line DL is coupled to the high power voltage line ELVDD_L. The power controller 115 may couple the data line DL and the high power voltage line ELVDD_L in the fourth period. The data driver 120 may provide the emission voltage VEL to the pixel PX through the data line DL during the fourth period. Here, the emission voltage may be greater than 0 V. Thus, the pixel PX may receive the voltage having a greater level than the high power voltage through the high power voltage line ELVDD_L.

Although the display panel 110 that includes the power controller 115 which determines whether the data line DL is coupled to the high power voltage line ELVDD_L is described, the display panel 110 is not limited thereto. The display panel 110 may include the power controller 115, which determines whether the data line DL is coupled to the low power voltage line. In this case, the power controller 115 may couple the data line DL and the low power voltage line in the fourth period. The data driver 120 may provide the emission voltage VEL to the pixel PX through the data line during the fourth period. Here, the emission voltage may be less than 0 V. Thus, the pixel PX may receive a voltage of lower level less than the low power voltage through the low power voltage line.

Figure 3:
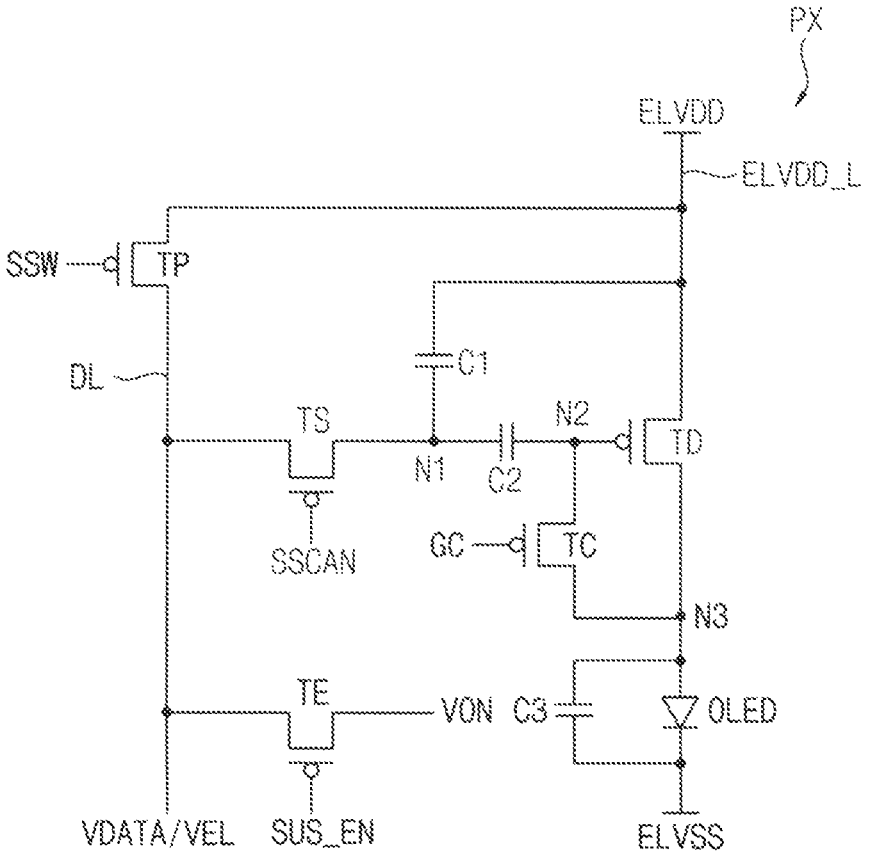
FIG. 3 is a circuit diagram illustrating an example of a pixel included in the display panel of FIG. 2.
Figure 4:
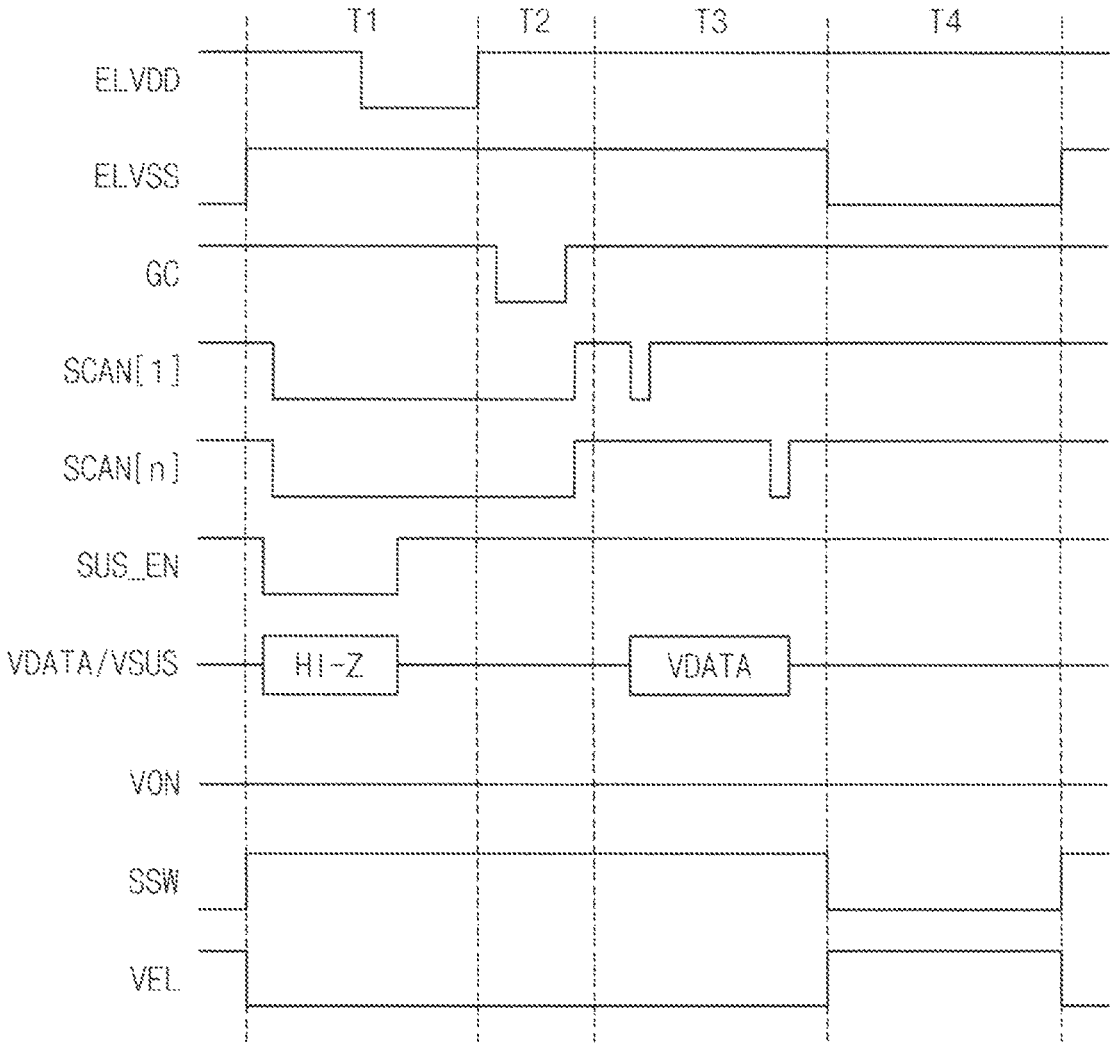
FIG. 4 is a timing chart illustrating for describing an operation of the pixel of FIG. 3.

FIG. 3 is a circuit diagram illustrating an example of a pixel included in the display panel of FIG. 2 and FIG. 4 is a timing chart illustrating for describing an operation of the pixel of FIG. 3.

Referring to FIG. 3, the pixel PX may include a first capacitor C1, a scan switching transistor TS, a second capacitor C2, a driving transistor TD, a control switching transistor TC, an enable transistor TE, an organic light emitting diode OLED, and a power switch transistor TP. Here, the power switch transistor TP may correspond to the power switch TP of FIG. 2.

The scan switching transistor TS may provide a data signal VDATA to a first node N1 in response to a scan signal SSCAN. For example, the scan switching transistor TS may have a gate electrode coupled to a scan line, a source electrode coupled to a data line DL, and a drain electrode coupled to the first node N1.

The first capacitor C1 may store the data signal VDATA provided through the scan switching transistor TS. For example, the first capacitor C1 may have a first electrode coupled to a high power voltage line and a second electrode coupled to the first node N1.

The driving transistor TD may generate a driving current provided to the organic light emitting diode OLED based on the voltage stored in the first capacitor C1. For example, the driving transistor TD may have a gate electrode coupled to the second node N2, a source electrode coupled to the high power voltage line ELVDD_L, and a drain electrode coupled to a third node N3.

The second capacitor C2 may charge a voltage between the first node N1 and the second node N2. For example, the second capacitor may have a first electrode coupled to the first node N1 and a second electrode coupled to the second node N2.

The control switching transistor TC may couple the second node N2 and the third node N3 in response to the control signal GC. For example, the control switching transistor TC may have a gate electrode coupled to the control line, a source electrode coupled to the second node N2, and a drain electrode coupled to the third node N3.

The enable transistor TE may provide an on-bias voltage VON to the data line DL in response to an enable signal SUS_EN. For example, the enable transistor TE may have a gate electrode coupled to an enable line, a source electrode coupled to a power voltage provider, and a drain electrode coupled to the data line DL. Here, the enable signal SUS_EN may be provided from the timing controller or the data driver. The on-bias voltage VON may be provided from the power voltage provider or the data driver.

The organic light emitting diode OLED may emit light in response to the driving current. For example, the organic light emitting diode OLED may have an anode electrode coupled to the third node N3 and a cathode electrode coupled to a low power voltage line.

The power switching transistor TP may couple the data line DL and a high power voltage line ELVDD_L in response to a switching signal SSW. For example, the power switch transistor TP may have a gate electrode coupled to the switching line that provides the switching signal SSW, a source electrode coupled to the high power voltage line ELVDD_L, and a drain electrode coupled to the data line.

Although the pixel PX of FIG. 3 includes PMOS transistors that turn on in response to a voltage having a low level, the pixels PX is not limited thereto. For example, the pixel PX may include NMOS transistors that turn on in response to a voltage having a high level.

Referring to FIG. 4, one frame may include a first period T1, a second period T2, a third period T3, and a fourth period T4.

The anode electrode of the organic light emitting diode OLED included in the pixel PX may be initiated during the first period T1. The enable transistor TE may turn on in response to the enable signal SUS_EN during the first period T1. When the enable transistor TE turns on, the on-bias voltage VON may be provided to the data line DL. The scan switching transistor TS may turn on in response to the scan signal SSCAN during the first period T1. When the scan switching transistor TS turns on, the data line DL may be electrically coupled to the first node N1. When the on-bias voltage VON is provided to the first node N1, the voltage of the second node N2 may be dropped by coupling of the second capacitor C2. Here, the on-bias voltage VON may have a voltage level that turns on the driving transistor TD. The on-bias voltage VON may be experimentally determined. When the voltage level of the second node N2 is decreased, the driving transistor TD may turn on. The high power voltage ELVDD having the low level may be provided to the anode electrode of the organic light emitting diode OLED. Thus, the anode electrode of the organic light emitting diode OLED may be initiated in the high power voltage ELVDD having the low level during the first period T1. The power switch transistor TP may turn off and the data line DL and the high power voltage line ELVDD_L may be decoupled during the first period T1.

The threshold voltage of the driving transistor TD included in the pixel PX may be compensated during the second period T2. The control switching transistor TC may turn on in response to the control signal GC during the second period T2. When the control switching transistor TC turns on, the second node N2 and the third node N3 may be electrically coupled. That is, the gate electrode and the drain electrode of the driving transistor TD may be coupled and the driving transistor TD may be implemented as a diode. Here, the voltage level of the second node N2 may be decreased the same amount as the voltage of the anode electrode of the organic light emitting diode OLED. The driving transistor TD may turn on when the voltage of the second node N2 is decreased. A voltage that is the same as the sum of the high power voltage ELVDD and the threshold voltage is provided to the second node N2 during the second period T2 because the high power voltage ELVDD having the high level is provided during the second period T2. The driving transistor TD may turn off when the voltage of the second node N2 is increased. Here, a reference voltage may be provided to the data line EL. The reference voltage may be the same as the data signal provided to one of the plurality of the data lines. The reference voltage may be provided to the first node N1. The second capacitor C2 may store the difference between the first node N1 and the second node N2. Here, the voltage of the second node N2 may correspond to the threshold voltage of the driving transistor TD. Thus, the threshold voltage of the driving transistor TD may be compensated. The power switch transistor TP may turn off and the data line DL and the high power voltage line ELVDD_L may be decoupled during the second period T2.

The data signal VDATA may be provided to the pixel during the third period T3. The control switching transistor TC may turn off in response to the control signal GC having the high level during the third period T3. The scan signal SSCAN may be sequentially provided through the scan lines. The data signal VDATA may be provided to the first node N1 through the data line when the scan switching transistor TS turns on in response to the scan signal SSCAN. The first capacitor C1 may charge the voltage of the first node N1. Here, the second capacitor C2 may maintain the voltage charged in the second period T2. The power switch transistor TP may turn off and the data line DL and the high power voltage line ELVDD_L may be decoupled during the third period T3.

The organic light emitting diode OLED of the pixel PX may emit light during the fourth period T4. The low power voltage ELVSS having the low level may be provided during the fourth period T4. In this case, the driving transistor TD may control an amount of the driving current flowing through the organic light emitting diode OLED corresponding to the voltage charged in the first capacitor C1 and the second capacitor C2. The power switch transistor TP may turn on in response to the switching signal SSW having the low level during the fourth period T4. The data line DL and the high power voltage line ELVDD_L when the power switch transistor TP turns on. The scan switching transistor TS may turn off and the data line DL and the first node N2 may be decoupled during the fourth period T4. The data driver may provide the emission voltage VEL through the data line DL. Here, the emission voltage VEL may be greater than 0 V. For example, the emission voltage VEL may have a voltage level that compensates for a voltage drop of the high power voltage or may have a voltage level that compensates for a brightness reduction resulting from a degradation of the organic light emitting diode OLED. The emission voltage VEL provided through the data line DL may be provided to the high power voltage line ELVDD_L because the data line DL and the high power voltage line ELVDD_L are electrically coupled. Thus, a voltage that is the same as the sum of the high power voltage ELVDD and the emission voltage VEL may be provided to the driving transistor TD during the fourth period T4. Therefore, the voltage drop occurring on the high power voltage line ELVDD_L may be compensated for.

As described above, the pixel PX may be operated in the first period T1, the second period T2, the third period T3, and the fourth period T4. The voltage greater than the high power voltage ELVDD may be provided to the driving transistor TD of the pixel PX during the fourth period T4 by coupling the data line DL and the high power voltage line ELVDD_L and providing the emission voltage VEL through the data line DL. Thus, the voltage drop of the high power voltage ELVDD may be compensated for.

Figure 5:
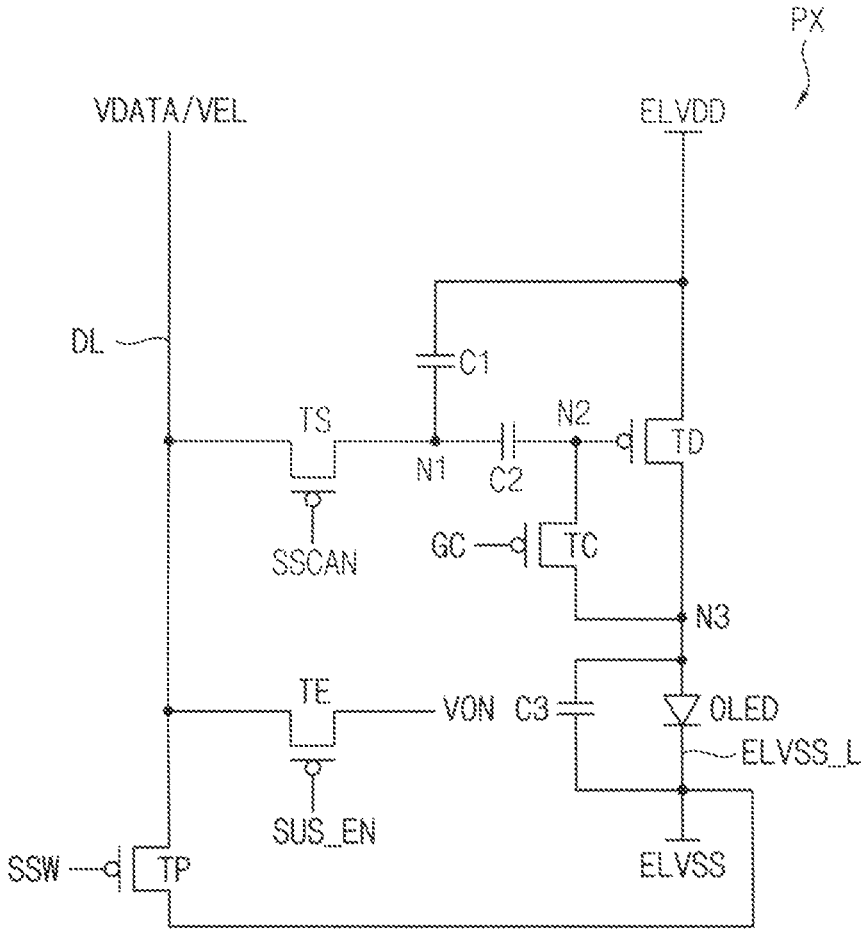
FIG. 5 is a circuit diagram illustrating other example of a pixel included in the display panel of FIG. 2.
Figure 6:
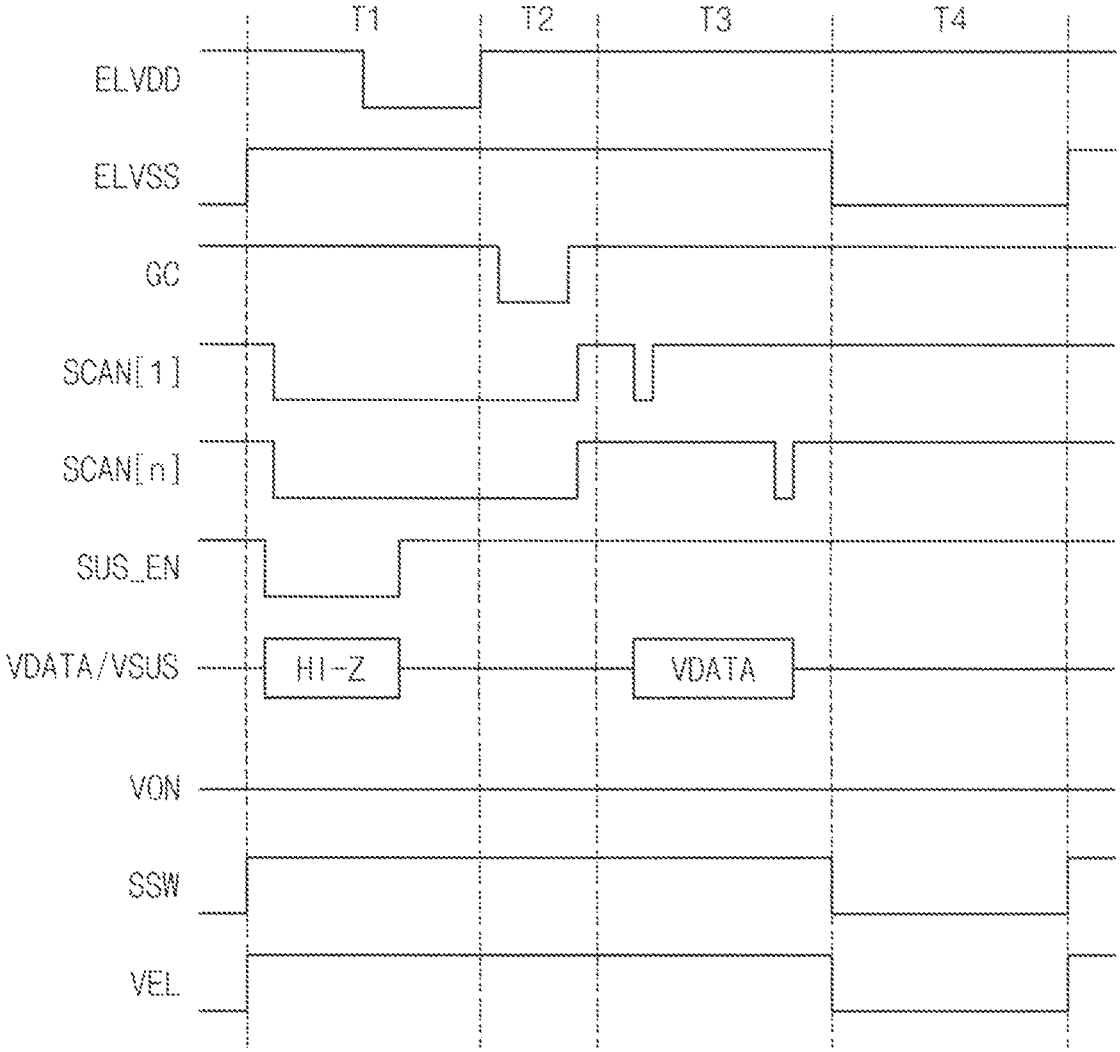
FIG. 6 is timing chart illustrating for describing an operation of the pixel of FIG. 5.

FIG. 5 is a circuit diagram illustrating another example of a pixel included in the display panel of FIG. 2 and FIG. 6 is timing chart illustrating for describing an operation of the pixel of FIG. 5.

Referring to FIG. 5, a pixel PX may include a first capacitor C1, a scan switching transistor TS, a second capacitor, a driving transistor TD, a control switching transistor TC, an enable transistor TE, an organic light emitting diode OLED, and a power switch transistor TP. Here, the power switch transistor TP may correspond to the power switch TP of FIG. 2.

The scan switching transistor TS may transmit a data signal VDATA to a first node N1 in response to a scan signal SSCAN. For example, the scan switching transistor TS may have a gate electrode coupled to a scan line, a source electrode coupled to a data line DL, and a drain electrode coupled to the first node N1.

The first capacitor C1 may store the data signal VDATA transmitted through the scan switching transistor TS. For example, the first capacitor C1 may have a first electrode coupled to a high power voltage line and a second electrode coupled to the first node N1.

The driving transistor TD may generate a driving current provided to the organic light emitting diode OLED based on a voltage stored in the first capacitor C1. For example, the driving transistor TD may include a gate electrode coupled to a second node N2, a source electrode coupled to the high power voltage line, and a drain electrode coupled to a third node N3.

The second capacitor C2 may charge a voltage between the first node N1 and the second node N2. For example, the second capacitor C2 may have a first electrode coupled to the first node N1 and a second electrode coupled to the second node N2.

The control switching transistor TC may couple the second node N2 and the third node N3 in response to the control signal GC. For example, the control switching transistor TC may have a gate electrode coupled to a control line, a source electrode coupled to the second node N2, and a drain electrode coupled to the third node N3.

The enable transistor TE may provide an on-bias voltage VON to the data line DL in response to an enable signal SUS_EN. For example, the enable transistor TE may have a gate electrode coupled to an enable line, a source electrode coupled to a power voltage provider, a drain electrode coupled to the data line DL. Here, the enable signal SUS_EN may be provided from the timing controller or the data driver. The on-bias voltage VON may be provided from the power voltage provider or the data driver.

The organic light emitting diode OLED may emit light in response to the driving current. For example, the organic light emitting diode OLED may have an anode electrode coupled to the third node N3 and a cathode electrode coupled to a low power voltage line.

The power switching transistor TP may couple the data line DL and a low power voltage line ELVSS_L in response to a switching signal SSW. For example, the power switch transistor TP may have a gate electrode coupled to the switching line that provides the switching signal SSW, a source electrode coupled to the high power voltage line ELVSS_L, and a drain electrode coupled to the data line.

Although the pixel PX of FIG. 5 includes PMOS transistors that turn on in response to a voltage having a low level, the pixels PX is not limited thereto. For example, the pixel PX may include NMOS transistors that turn on in response to a voltage having a high level.

Referring to FIG. 6, one frame may include a first period T1, a second period T2, a third period T3, and a fourth period T4.

The anode electrode of the organic light emitting diode OLED included in the pixel PX may be initiated in the first period T1. The enable transistor TE may turn on in response to the enable signal SUS_EN during the first period T1. When the enable transistor TE turns on, the on-bias voltage VON may be provided to the data line DL. The scan switching transistor TS may turn on in response to the scan signal SSCAN during the first period T1. When the scan switching transistor TS turns on, the data line DL may be electrically coupled to the first node N1. When the on-bias voltage VON is provided to the first node N1, the voltage of the second node N2 may be dropped by coupling of the second capacitor C2. Here, the on-bias voltage VON may have a voltage level that turns on the driving transistor TD. The on-bias voltage VON may be experimentally determined. When the voltage level of the second node N2 is decreased, the driving transistor TD may turn on. The high power voltage ELVDD having the low level may be provided to the anode electrode of the organic light emitting diode OLED. Thus, the anode electrode of the organic light emitting diode OLED may be initiated in the high power voltage ELVDD having the low level during the first period T1. The power switch transistor TP may turn off and the data line DL and the low power voltage line ELVSS_L may be decoupled during the first period T1.

The threshold voltage of the driving transistor TD included in the pixel PX may be compensated during the second period T2. The control switching transistor TC may turn on in response to the control signal GC during the second period T2. When the control switching transistor TC turns on, the second node N2 and the third node N3 may be electrically coupled. That is, the gate electrode and the drain electrode of the driving transistor TD may be coupled and the driving transistor TD may be implemented as a diode. Here, the voltage level of the second node N2 may be decreased the same amount as the voltage of the anode electrode of the organic light emitting diode OLED. The driving transistor TD may turn on when the voltage of the second node N2 is decreased. A voltage that is the same as the sum of the high power voltage ELVDD and the threshold voltage is provided to the second node N2 during the second period T2 because the high power voltage ELVDD having the high level is provided during the second period T2. The driving transistor TD may turn off when the voltage of the second node N2 is increased. Here, a reference voltage may be provided to the data line DL. The reference voltage may be the same as the data signal provided to one of the plurality of the data lines. The reference voltage may be provided to the first node N1. The second capacitor C2 may store the difference between the first node N1 and the second node N2. Here, the voltage of the second node N2 may corresponds to the threshold voltage of the driving transistor TD. Thus, the threshold voltage of the driving transistor TD may be compensated. The power switch transistor TP may turn off and the data line DL and the low power voltage line ELVSS_L may be decoupled during the second period T2.

The data signal VDATA may be provided to the pixel during the third period T3. The control switching transistor TC may turn off in response to the control signal GC having the high level during the third period T3. The scan signal SSCAN may be sequentially provided through the scan lines. The data signal VDATA may be provided to the first node N1 through the data line DL when the scan switching transistor TS turns on in response to the scan signal SSCAN. The first capacitor C1 may charge the voltage of the first node N1. Here, the second capacitor C2 may maintain the voltage charged in the second period T2. The power switch transistor TP may turn off and the data line DL and the low power voltage line ELVSS_L may be decoupled during the third period T3.

The organic light emitting diode OLED of the pixel PX may emit light during the fourth period T4. The low power voltage ELVSS having the low level may be provided during the fourth period T4. In this case, the driving transistor TD may control an amount of the driving current flowing through the organic light emitting diode OLED corresponding to the voltage charged in the first capacitor C1 and the second capacitor C2. The power switch transistor TP may turn on in response to the switching signal SSW having the low level during the fourth period T4. The data line DL and the low power voltage line ELVSS_L are coupled when the power switch transistor TP turns on. The scan switching transistor TS may turn off and the data line DL and the first node N1 may be decoupled during the fourth period T4. The data driver may provide the emission voltage VEL through the data line DL. Here, the emission voltage VEL may be less than 0 V. For example, the emission voltage VEL may have a voltage level that compensates for a voltage drop of the low power voltage ELVSS or may have a voltage level that compensates for a brightness reduction resulting from a degradation of the organic light emitting diode OLED. The emission voltage VEL provided through the data line DL may be provided to the low power voltage line ELVSS_L because the data line DL and the low power voltage line ELVSS_L are electrically coupled. Thus, a voltage that is the same as the sum of the low power voltage ELVSS and the emission voltage VEL may be provided to the cathode electrode of the organic light emitting diode OLED during the fourth period T4. Therefore, the voltage drop occurring on the low power voltage line ELVSS_L may be compensated for.

As described above, the pixel PX may be operated in the first period T1, the second period T2, the third period T3, and the fourth period T4. A voltage lower than the low power voltage ELVSS may be provided to the driving transistor TD of the pixel PX during the fourth period T4 by coupling the data line DL and the low power voltage line ELVSS_L and providing the emission voltage VEL through the data line DL. Thus, the voltage drop of the low power voltage ELVSS may be compensated for.

Figure 7:
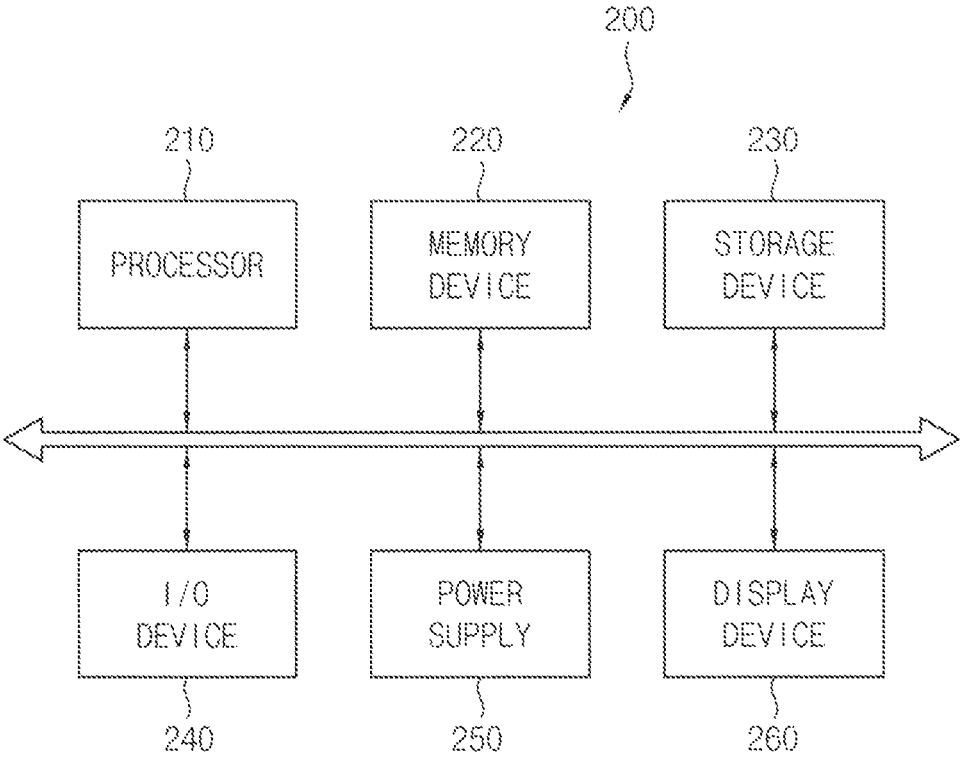
FIG. 7 is a block diagram illustrating an electronic device according to example embodiments.
Figure 8:
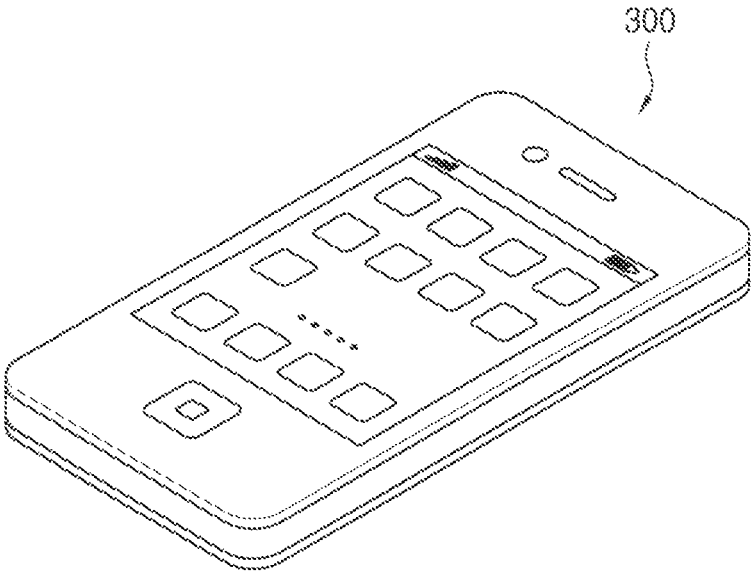
FIG. 8 is a diagram illustrating an example embodiment in which the electronic device of FIG. 7 is implemented as a smart phone.

FIG. 7 is a block diagram illustrating an electronic device according to example embodiments and FIG. 8 is a diagram illustrating an example embodiment in which the electronic device of FIG. 7 is implemented as a smart phone.

Referring to FIGS. 7 and 8, an electronic device 200 may include a processor 210, a memory device 220, a storage device 230, an input/output (I/O) device 240, a power device 250, and a display device 260. Here, the display device 260 may correspond to the display device 100 of FIG. 1. In addition, the electronic device 200 may further include a plurality of ports for communicating a video card, a sound card, a memory card, a universal serial bus (USB) device, other electronic device, etc. Although it is illustrated in FIG. 8 that the electronic device 200 is implemented as a smart phone 300, embodiments of the electronic device 200 are not limited thereto.

The processor 210 may perform various computing functions. The processor 210 may be a microprocessor, a central processing unit (CPU), etc. The processor 210 may be coupled to other components via an address bus, a control bus, a data bus, etc. Further, the processor 210 may be coupled to an extended bus such as Peripheral Component Interconnect (PCI) bus. The memory device 220 may store data for operations of the electronic device 200. For example, the memory device 220 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 230 may be a solid stage drive (SSD) device, a hard disk drive (HDD) device, a CD-ROM device, etc.

The I/O device 240 may be an input device such as a keyboard, a keypad, a touchpad, a touch-screen, a mouse, etc, and an output device such as a printer, a speaker, etc. In some example embodiments, the display device 260 may be included in the I/O device 240. The power device 250 may provide a power for operations of the electronic device 200. The display device 260 may communicate with other components via the buses or other communication links. As described above, the display device 260 may include a display panel, a data driver, a scan driver, a power voltage provider, and a timing controller. A plurality of data lines and a plurality of scan lines may be formed in the display panel. A plurality of pixels may be formed in intersection regions of the data lines and the scan lines. The display panel may include a power controller. The power controller may be formed in a non-display area of the display panel. The power controller may determine whether the data line is coupled to a high power voltage line or to a low power voltage line. The power controller may include power switches that turn on in response to a switching signal. The power switch may couples the data line and the high power voltage line or the low power voltage line by turning on during an emission period of the pixel. Here, a scan switching transistor of the pixel may turn off and the pixel and the data line may be decoupled. The data driver may provide an emission voltage to the pixel through the data line during the emission period of the pixel. When the data line is coupled to the high power voltage line, the emission voltage may have a voltage level greater than 0 V. When the data line is coupled to the low power voltage line, the emission voltage may have a voltage level less than 0 V. The emission voltage may be provided to the high power voltage line or the low power voltage line through the data line during the emission period. Thus, the voltage having a greater voltage level than the voltage level of the high power voltage or the voltage having a lower voltage level than the voltage level of the low power voltage may be provided to the pixel during the emission period. The data driver may provide a data signal to the pixels through the data lines during the scan period and may provide the emission voltage to the pixels through the data lines during the emission period. The scan driver may provide a scan signal through the scan lines. The scan driver may not provide the scan signal to the pixels during the emission period. The power voltage provider may provide the high power voltage to the pixels through the high power voltage line and may provide the low power voltage to the pixels through the low power voltage line. The power voltage provider may provide the high power voltage and the low power voltage to the pixel during the emission period. The timing controller may generate control signals that control the data driver and the scan driver.

As described above, the electronic device 200 of FIG. 7 may couple the data line and the high power voltage line or may couple the data line and the low power voltage line. The electronic device 200 may provide the voltage having a greater voltage level than the voltage level of the high power voltage or the voltage having a lower voltage level than the voltage level of the low power voltage may be provided to the pixels during the emission period by providing the emission voltage through the data line. Thus, a brightness reduction of the display device 260 resulting from a voltage drop of the high power voltage or a voltage drop of the low power voltage may be compensated for.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a display panel including a plurality of pixels;

a data driver configured to provide a data signal and an emission voltage that compensates a voltage drop of a high power voltage or a voltage drop of a low power voltage to the plurality of pixels through a plurality of data lines;

a scan driver configured to provide a scan signal to the plurality of pixels through a plurality of scan lines;

a power voltage provider configured to provide the high power voltage to the plurality of pixels through a high power voltage line and to provide the low power voltage to the plurality of pixels through a low power voltage line; and a timing controller configured to generate control signals that control the data driver and the scan driver, wherein the display panel includes a power controller that is configured to determine whether the data line is coupled to the high power voltage line or to the low power voltage line, wherein the power controller couples the data line to the high power voltage line or the low power voltage line during an emission period of a pixel of pixels, and wherein the data driver provides the emission voltage to the high power voltage line or the low power voltage line through the data line coupled to the high power voltage line or the low power voltage line during the emission period of the pixel of pixels.

2. The display device of claim 1, wherein the power controller includes a plurality of power switches that turn on or turn off in response to a switching signal.

3. The display device of claim 2, wherein at least one power switch of the plurality of power switches is formed between the high power voltage line and the data line.

4. The display device of claim 3, wherein the at least one power switch turns on during the emission period of a pixel of the plurality of pixels.

5. The display device of claim 3, wherein the data driver provides the emission voltage to the pixel through the data line during the emission period of the pixel.

6. The display device of claim 2, wherein the at least one power switch is formed between the low power voltage line and the data line.

7. The display device of claim 6, wherein the at least one power switch turns on during the emission period of a pixel of the plurality of pixels.

8. The display device of claim 6, wherein the data driver provides the emission voltage to the pixels through the data line during the emission period of the pixel.

9. The display device of claim 2, wherein the at least one power switch is implemented as a p-channel metal oxide semiconductor (PMOS) transistor.

10. The display device of claim 2, wherein the at least one power switch is implemented as an n-channel metal oxide semiconductor (NMOS) transistor.

11. The display device of claim 1, the power controller is formed in a non-display area of the display panel.

12. An electronic device includes a display device and a processor that controls the display device, wherein the display device comprising:

a display panel including a plurality of pixels;

a data driver configured to provide a data signal and an emission voltage that compensates a voltage drop of a high power voltage or a voltage drop of a low power voltage to the plurality of pixels through a plurality of data lines;

a scan driver configured to provide a scan signal to the plurality of pixels through a plurality of scan lines;

a power voltage provider configured to provide the high power voltage to the plurality of pixels through a high power voltage line and to provide the low power voltage to the plurality of pixels through a low power voltage line; and a timing controller configured to generate control signals that control the data driver and the scan driver; and wherein the display panel includes a power controller that is configured to determine whether the data line is coupled to the high power voltage line or to the low power voltage line, wherein the power controller couples the data line to the high power voltage line or the low power voltage line during an emission period of a pixel of pixels, and wherein the data driver provides the emission voltage to the high power voltage line or the low power voltage line through the data line coupled to the high power voltage line or the low power voltage line during the emission period of the pixel of pixels.

13. The electronic device of claim 12, wherein the power controller includes a plurality of power switches that turn on or turn off in response to a switching signal.

14. The electronic device of claim 13, wherein the at least one power switch of the plurality of power switches is formed between the high power voltage line and the data line.

15. The electronic device of claim 14, wherein the at least one power switch turns on during the emission period of a pixel of the plurality of pixels.

16. The electronic device of claim 14, wherein the data driver provides the emission voltage to a pixel of the plurality of pixels through the data line during the emission period of the pixel.

17. The electronic device of claim 13, wherein the at least one power switch of a plurality of power switches is formed between the low power voltage line and the data line.

18. The electronic device of claim 17, wherein the at least one power switch turns on during the emission period of a pixel of the plurality of pixels.

19. The electronic device of claim 17, wherein the data driver provides the emission voltage to the pixel through the data line during the emission period of the pixel.

20. The electronic device of claim 12, wherein the power controller is formed in a non-display area of the display panel.

* * * * *